US005803070A

United States Patent [19]

Martin et al.

[11] Patent Number: 5,803,070

[45] Date of Patent: Sep. 8, 1998

[54] ARCHERY BOWS WITH STABILIZER RECEIVERS, AND STABILIZER RECEIVERS CONFIGURED FOR MOUNTING ARCHERY BOW STABILIZERS IN VARIABLE POSITIONS RELATIVE TO ARCHERY BOWS

[75] Inventors: Terry G. Martin, Walla Walla, Wash.; George T. Newbold, Milton-Freewater, Oreg.

[73] Assignee: Martin Archery Inc., Walla Walla, Wash.

[21] Appl. No.: 775,899

[22] Filed: Jan. 2, 1997

[51] Int. Cl.[6] ..... F41B 5/00

[52] U.S. Cl. ..... 124/88; 124/89; D22/107

[58] Field of Search ..... 124/23.1, 25.6, 124/86, 88, 89; D22/107

[56] References Cited

U.S. PATENT DOCUMENTS

| | | | |
|---|---|---|---|
| 3,196,860 | 7/1965 | Hoyt | 124/89 |
| 3,502,062 | 3/1970 | Shurts | 124/23.1 |
| 3,525,322 | 8/1970 | Lee | 124/89 |
| 3,589,350 | 6/1971 | Hoyt et al. | 124/89 |
| 3,752,142 | 8/1973 | Morita et al. | 124/24.1 |
| 3,804,072 | 4/1974 | Izuta | 124/89 |
| 3,840,944 | 10/1974 | Gresley | 124/88 X |
| 4,054,121 | 10/1977 | Hoyt | 124/89 |
| 4,296,725 | 10/1981 | Broderick | 124/23.1 |
| 4,324,222 | 4/1982 | Gasser | 124/89 |
| 4,556,042 | 12/1985 | Izuta | 124/89 |
| 4,615,327 | 10/1986 | Saunders | 124/89 |
| 4,643,159 | 2/1987 | Ryan | 124/88 |
| 4,787,361 | 11/1988 | Vyprachticky | 124/88 |
| 4,889,102 | 12/1989 | Martin | 124/88 |
| 5,433,792 | 7/1995 | Darlington | 124/25.6 |
| 5,535,731 | 7/1996 | Webster | 124/89 |

*Primary Examiner*—John A. Ricci
*Attorney, Agent, or Firm*—Wells, St. John, Roberts, Gregory & Matkin, P.S.

[57] ABSTRACT

The invention encompasses archery bows with stabilizer receivers and archery bow stabilizer receivers. In one aspect, the invention encompasses an archery bow handle defining a major longitudinal handle axis comprising: a) a first end; b) a second end longitudinally displaced from the first end; c) a handgrip portion positioned longitudinally between the first and second ends and configured to be grasped by an archer's hand; d) a stabilizer receiver forwardly displaced from the handgrip portion and configured to receive an archery bow stabilizer, the stabilizer receiver and the handgrip portion overlapping at a common longitudinal displacement from the first end; and e) a cavity between the stabilizer receiver and the handgrip portion, the cavity being sized to enable one or more of the fingers of the archer's hand to slide between the handgrip portion and the stabilizer receiver. In anther aspect, the invention encompasses a stabilizer receiver configured for use with an archery bow and configured for mounting an archery bow stabilizer in variable positions relative to the archery bow comprising: a) a body; and b) an archery bow stabilizer receiving system associated with the body, the receiving system permitting displacement of an archery bow stabilizer across a range of variable positions.

32 Claims, 5 Drawing Sheets

ARCHERY BOWS WITH STABILIZER RECEIVERS, AND STABILIZER RECEIVERS CONFIGURED FOR MOUNTING ARCHERY BOW STABILIZERS IN VARIABLE POSITIONS RELATIVE TO ARCHERY BOWS

TECHNICAL FIELD

This invention relates to archery bows, handles for archery bows, and stabilizer receivers for archery bows.

BACKGROUND OF THE INVENTION

Archery bows are typically constructed with an insert for attaching an archery bow stabilizer to the bow. Archery bow stabilizers are utilized to absorb limb vibration, add mass weight to a bow, and allow an archer to hold steadier on target by giving a desired balance to a bow. Target bow stabilizers up to three feet long are not uncommon, but hunting bow stabilizers are usually under 12 inches. Some hunting bow stabilizers may be used for storage of small accessories or survival gear.

It would be desirable to place an archery bow stabilizer near the center of an archery bow to provide optimum balance priorities. However, such desired placement of an archery bow stabilizer would place the bow stabilizer at an archer's handgrip, and would thus interfere with the archer's ability to grip the bow. Further, the optimal location of a stabilizer relative to an archery bow will depend upon characteristics of the bow, and characteristics of the archer.

Bows are frequently used for hunting. It is frequently desirable to have hunting bows be relatively short so that the bows do not get hung-up in brush as an archer is stalking prey. Stabilizers are currently typically mounted on a riser portion of an archery bow and offset relative to a handgrip portion of an archery bow. The riser portions must therefore be extended well beyond the handgrip portion to provide room to receive a stabilizer. Accordingly, it would be desirable to develop a mechanism for mounting a stabilizer whereby the stabilizer could overlap a handgrip portion and thus enable archery bow riser portions to be shortened.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

In one aspect, the invention encompasses an archery bow handle defining a major longitudinal handle axis comprising:

a first end;

a second end longitudinally displaced from the first end;

a handgrip portion positioned longitudinally between the first and second ends and configured to be grasped by an archer's hand;

a stabilizer receiver forwardly displaced from the handgrip portion and configured to receive an archery bow stabilizer, the stabilizer receiver and the handgrip portion overlapping at a common longitudinal displacement from the first end; and a cavity between the stabilizer receiver and the handgrip portion, the cavity being sized to enable one or more of the fingers of the archer's hand to slide between the handgrip portion and the stabilizer receiver.

In another aspect, the invention encompasses an archery bow handle defining a major longitudinal handle axis comprising:

a handgrip portion;

a stabilizer receiver laterally displaced from the handgrip portion and configured to engage an archery bow stabilizer; and a cavity between the stabilizer receiver and the handgrip portion.

In yet another aspect, the invention encompasses a stabilizer receiver configured for use with an archery bow and configured for mounting an archery bow stabilizer in variable positions relative to the archery bow comprising:

a body; and an archery bow stabilizer receiving system associated with the body, the receiving system permitting displacement of an archery bow stabilizer across a range of variable positions.

Figure 1:
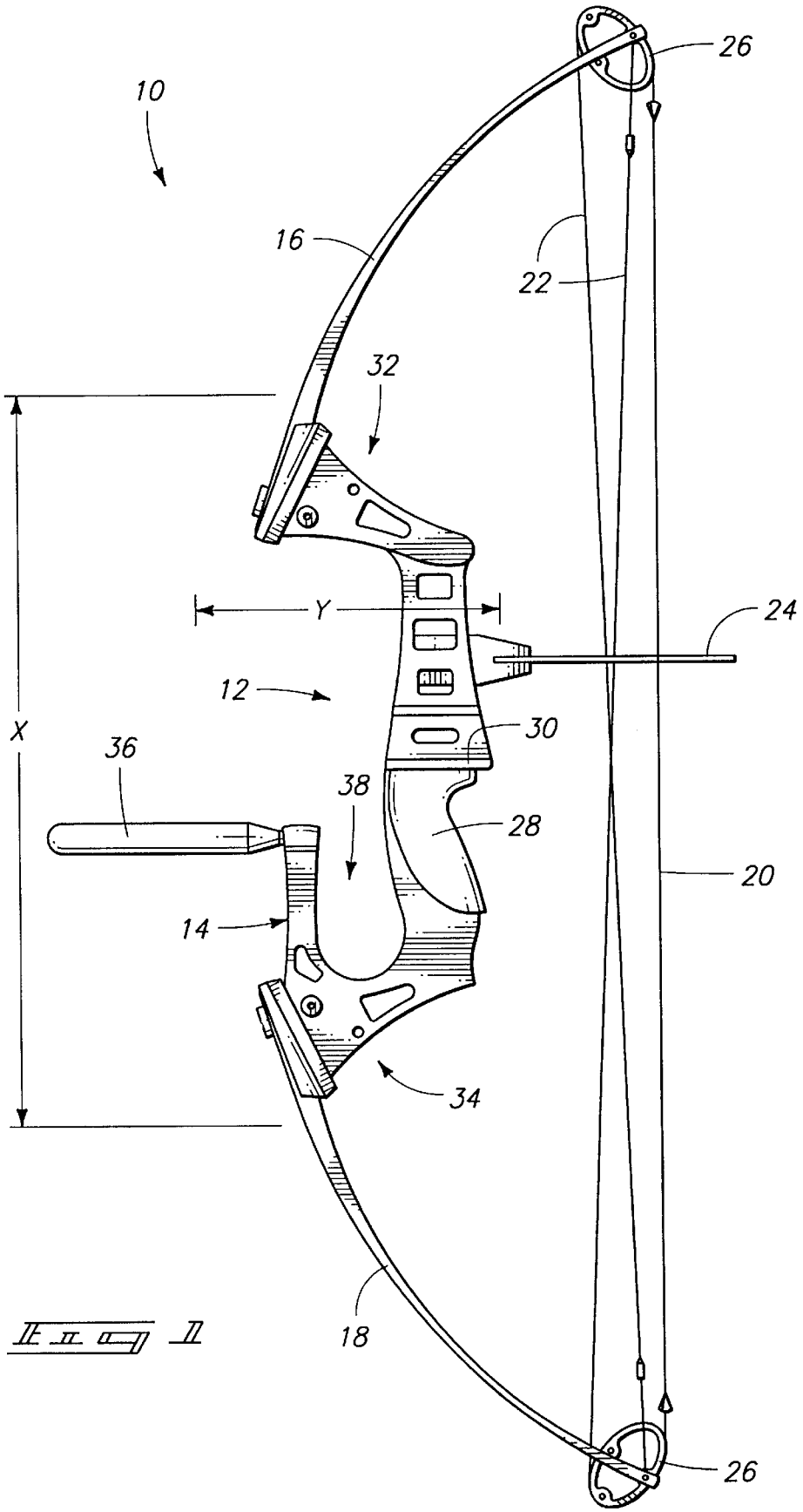
FIG. 1 is a side elevational view of an archery bow illustrating a first embodiment stabilizer receiver of the present invention.

Referring to FIG. 1 an archery bow 10 is illustrated. Archery bow 10 comprises a handle riser portion 12 and associated stabilizer receiver 14 constructed according to a first embodiment of the present invention. Bow 10 further comprises a top limb 16, a lower limb 18, a bow string 20, power cables 22, a cable guard assembly 24, and eccentric wheels 26.

Handle riser portion 12 comprises a handgrip portion 28 below a shelf 30. Handle riser portion 12 defines a major longitudinal axis "X" and a transverse axis "Y" extending perpendicularly to longitudinal axis "X." Handle riser portion 12 may alternatively be referred to as an archery bow handle 12.

Archery bow handle 12 comprises a first end 32 and a second end 34 longitudinally displaced from first end 32. Handgrip portion 28 is positioned longitudinally between first end 32 and second end 34, and is configured to be grasped by an archer's hand. Stabilizer receiver 14 is forwardly displaced from handgrip portion 28, with the direction "forwardly" being defined as a direction in which an arrow would be launched from bow 10. Stabilizer receiver 14 and handgrip portion 28 overlap at a common longitudinal displacement from first end 32. Stabilizer receiver 14 is configured to receive a stabilizer 36. Stabilizer receiver 14 preferably comprises a threaded aperture which matingly receives a threaded extension (not shown) of stabilizer 36. For example, receiver 14 may comprise a single threaded aperture similar to apertures 40 which are shown and described with reference to FIGS. 2 and 3 below regarding a second embodiment of the present invention.

A cavity 38 is between stabilizer receiver 14 and handgrip portion 28. Cavity 38 is ideally sized to enable one or more fingers of an archer's hand to slide between handgrip portion 28 and stabilizer receiver 14. In the shown preferred embodiment, stabilizer receiver 14 is integral with archer bow handle 12 and handgrip portion 28.

Stabilizer receiver 14 is laterally displaced forwardly of handgrip portion 28. Stabilizer receiver 14 can thereby advantageously permit placement of a stabilizer 36 in a configuration which overlaps handgrip portion 28 at a common longitudinal displacement from first end 32, and yet which does not interfere with an archer's ability to grasp or otherwise position its hand relative to handgrip portion 28. The longitudinal overlap of stabilizer 36 and handgrip portion 28 advantageously enables handle riser 12 to be shortened relative to prior art handle risers wherein a stabilizer receiver was placed above or below a handgrip portion.

Figure 2:
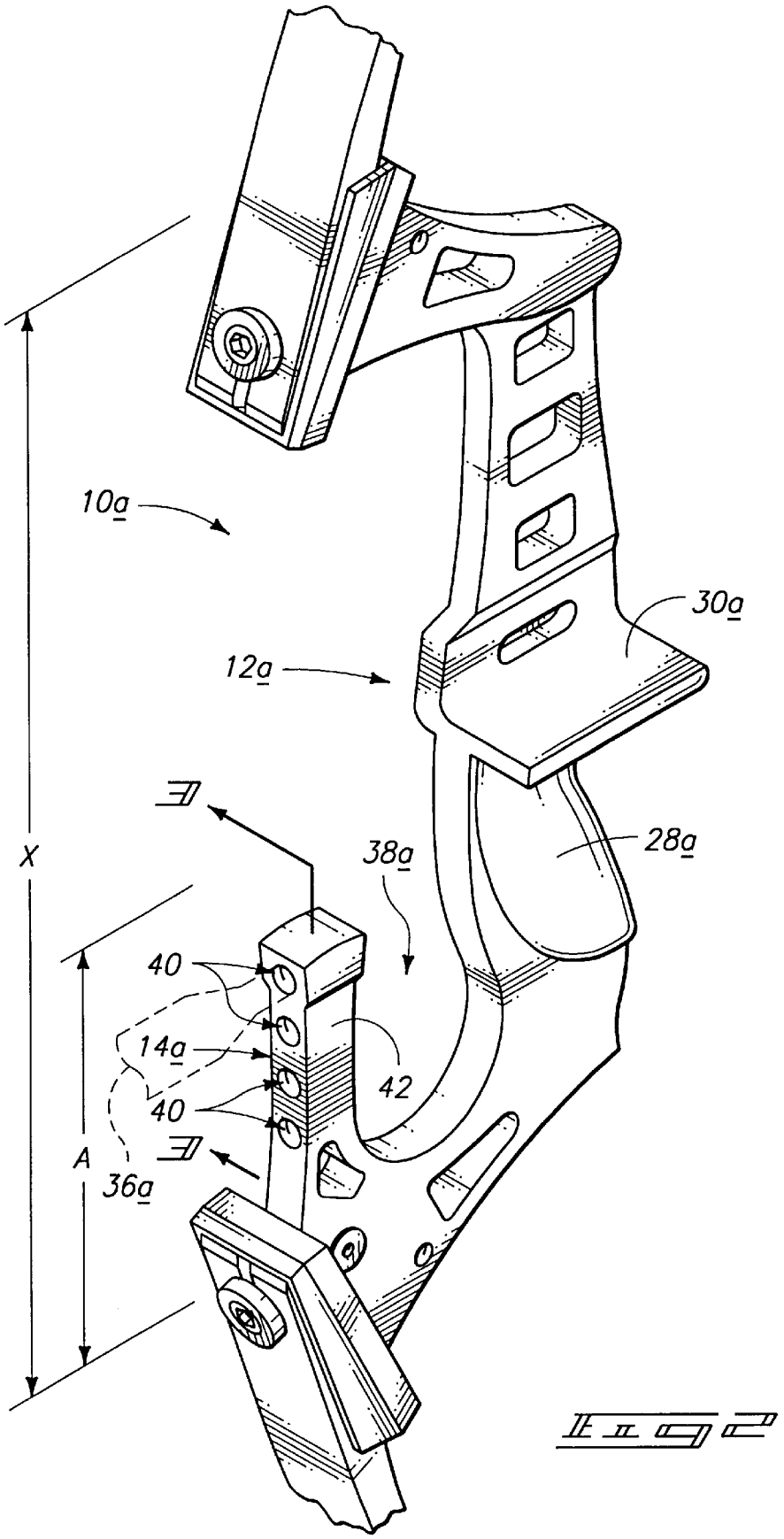
FIG. 2 is an enlarged fragmentary perspective view of a handle riser section of an archery bow illustrating a second embodiment of a stabilizer receiver of the present invention.
Figure 3:
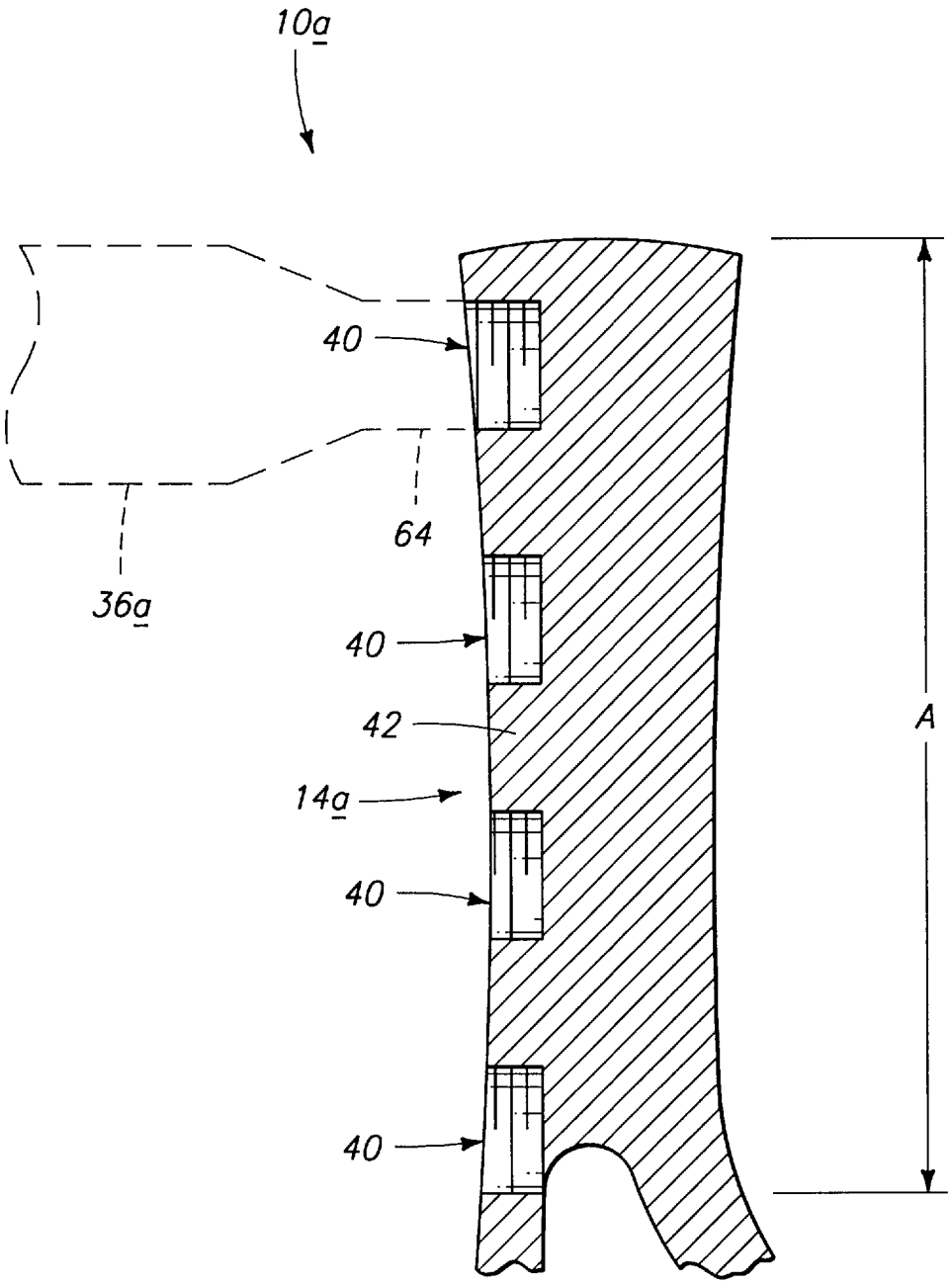
FIG. 3 is an enlarged fragmentary sectional side view along the line 3—3 of FIG. 2.
Figure 4:
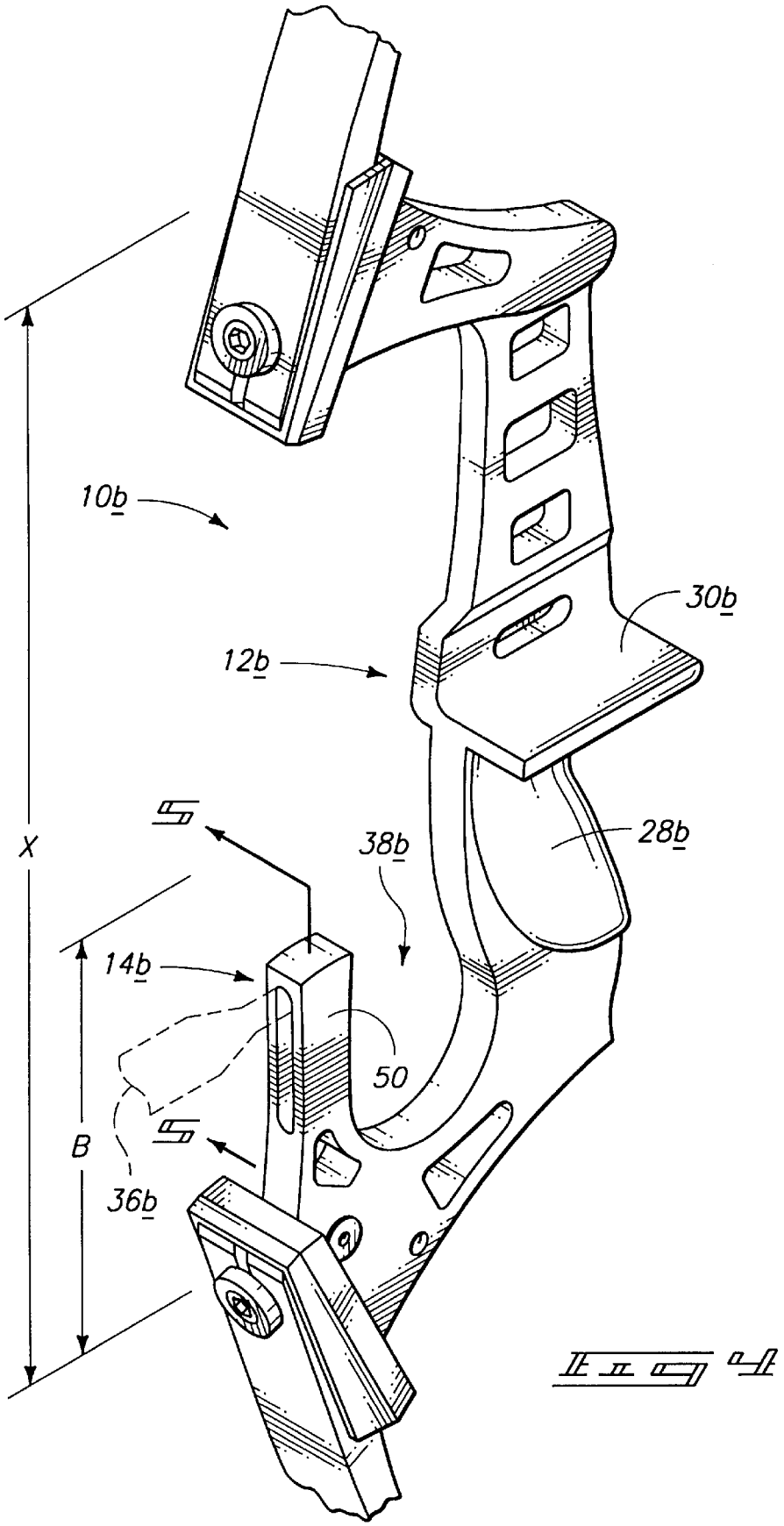
FIG. 4 is a fragmentary perspective view of a handle riser portion of an archery bow illustrating a third embodiment of a stabilizer receiver of the present invention.
Figure 5:
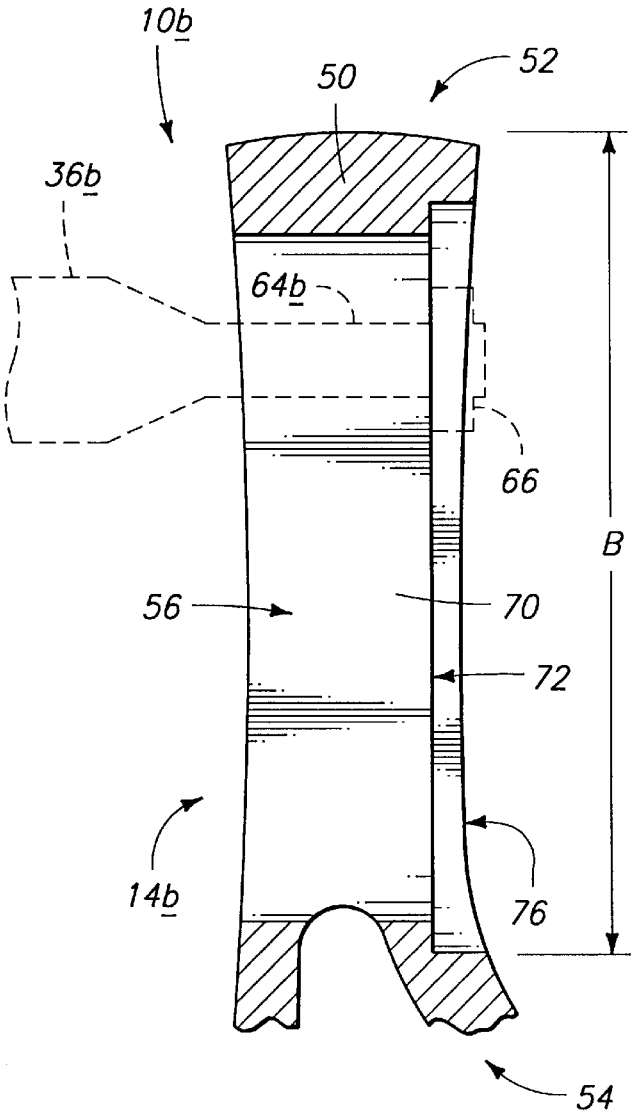
FIG. 5 is an enlarged fragmentary sectional side view along the line 5—5 of FIG. 4.
Figure 6:
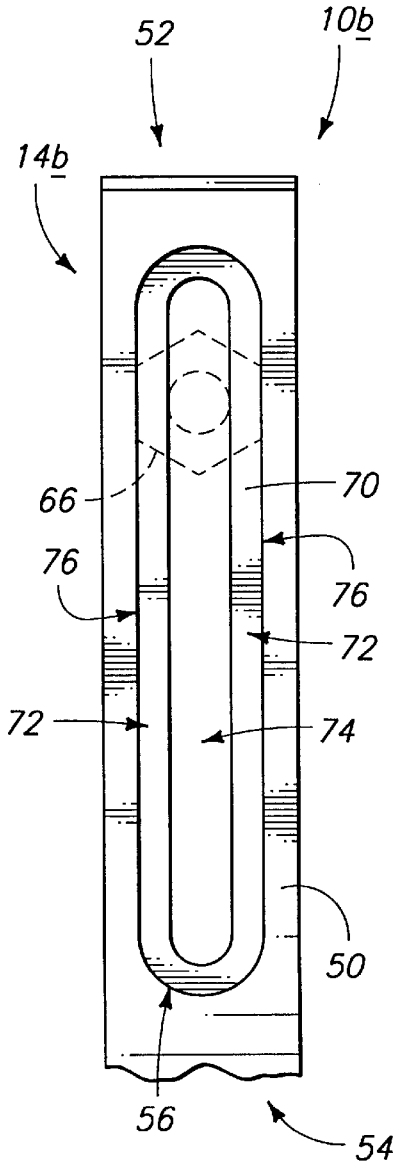
FIG. 6 is an enlarged fragmentary back view of the stabilizer receiver of FIG. 4.

FIGS. 2–6 illustrate alternate embodiments of the present invention wherein a stabilizer receiver is configured for mounting an archery bow stabilizer in variable positions relative to an archery bow. FIGS. 2 and 3 illustrate a second embodiment of the present invention, and FIGS. 4–6 illustrate a third embodiment of the present invention.

Referring to the second embodiment of FIGS. 2 and 3, like numerals from the preceding discussion of the first embodiment are utilized where appropriate, with differences being indicated by the suffix "a" or with different numerals.

Archery bow 10*a* comprises a handle riser portion 12*a*. Handle riser portion 12*a* comprises a handgrip portion 28*a* and a shelf 30*a* above handgrip portion 28*a*. A stabilizer receiver 14*a* is forwardly displaced from handgrip portion 28*a*. A cavity 38*a* is between stabilizer receiver 14*a* and handgrip portion 28*a*. Stabilizer receiver 14*a* comprises a plurality of apertures 40 configured to permit variable positioning of an archery bow stabilizer received within stabilizer receiver 14*a*. Apertures 40 permit variable positioning of an archery bow stabilizer 36*a* (shown in phantom view).

Stabilizer receiver 14*a* comprises a body 42. Body 42 comprises a major longitudinal axis "A" which preferably substantially parallels major longitudinal axis "X" of handle riser portion 12*a*. Apertures 40 are displaced from one another along major longitudinal axis "A." Apertures 40 extend within body 42 and are configured to threadably engage a threaded extension, such as the extension 64 of stabilizer 36*a*.

The second embodiment of the present invention permits variable positioning of a stabilizer relative to an archery bow. More specifically, the second embodiment of the present invention permits displacement of a stabilizer across a range of variable positions determined by apertures 40. However, the second embodiment of the present invention permits only discontinuous displacement across such range of variable positions. A third embodiment of the present invention, discussed below with reference to FIGS. 4–6, permits continuous displacement across a range of variable positions.

Referring to FIGS. 4–6, the third embodiment of the present invention is illustrated with like numerals from the preceding discussion of the first embodiment utilized where appropriate, with differences being indicated by the suffix "b" or with different numerals.

Archery bow 10*b* comprises a handle riser portion 12*b*. Handle riser portion 12*b* comprises a handgrip portion 28*b* and a shelf 30*b* above handgrip portion 28*b*. Handle riser portion 12*b* further comprises a stabilizer receiver 14*b* laterally displaced from handgrip portion 28*b*. A gap 38*b* is between handgrip portion 28*b* and stabilizer receiver 14*b* and is preferably configured to enable insertion of one or more of an archer's fingers therethrough.

Stabilizer receiver 14*b* comprises a body 50 having a major longitudinal axis "B." Preferably, axis "B" is substantially parallel to longitudinal axis "X" of handle riser portion 12*b*. Body 50 comprises a first end 52 and a second end 54 longitudinally displaced from first end 52. Body 50 further comprises a slot 56 positioned between first end 52 and second end 54. Slot 56 is configured to permit variable positioning of an archery bow stabilizer 36*b* (shown in phantom view) received within stabilizer receiver 14*b*. In the shown preferred embodiment, slot 56 extends longitudinally between first end 52 and second end 54 and thus permits variable longitudinal positioning of stabilizer 36*b* engaged within stabilizer receiver 14*b*.

Body 50 comprises an elongated shoulder 70 provided substantially coextensively within elongated slot 56. Shoulder 70 is defined by opposed inwardly facing abutments 72 separated by a space 74. Space 74 has a sufficient width to slidably receive a threaded bolt 64*b* of archery bow stabilizer 36*b*. Abutments 72 comprise exposed surfaces which define bearing surfaces against which a predetermined size threaded nut 66 received by threaded bolt 64*b* can tightly bear for securing stabilizer 36*b* to stabilizer receiver 14*b*. Slot 56 defines locking wrench jaws 76 adjacent abutments 72 and adapted to slidably receive threaded nut 66 therebetween but prevent nut 66 from rotating within slot 56.

Slot 56 comprises a space above abutments 72 and between locking jaws 76, and further comprises space 74 between abutments 72. Slot 56 thus extends entirely through body 14*b*. The depth of abutments 72 within body 14*b* is illustrated to be about 15 percent of a transverse thickness of body 50. However, such depth is merely an example depth. As will be recognized by persons of ordinary skill in the art, the depth of abutments 72 can be varied to accommodate various thickness of nuts and various designs of archery bow stabilizers.

An alternative way of describing stabilizer receiver 14*b* is that receiver 14*b* comprises a body 50 and an archery bow stabilizer receiving system comprising slot 56 associated with body 50. The archery bow stabilizer receiving system permits displacement of an archery bow stabilizer 36*b* across a range of variable positions between first end 52 and second end 54. Further, the archery bow stabilizer receiving system permits continuous displacement of archery bow stabilizer 36*b* across the range of variable positions between first end 52 and second end 54.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. An archery bow handle defining a major longitudinal handle axis comprising:

a first end;

a second end longitudinally displaced from the first end;

a handgrip portion positioned longitudinally between the first and second ends and configured to be grasped by an archer's hand;

a stabilizer receiver forwardly displaced from the handgrip portion and configured to receive a threaded extension of an archery bow stabilizer and to support an entirety of said archery bow stabilizer by the threaded extension, the stabilizer receiver and the handgrip portion overlapping at a common longitudinal displacement from the first end; and a cavity between the stabilizer receiver and the handgrip portion, the cavity being sized to enable one or more of the fingers of the archer's hand to slide between the handgrip portion and the stabilizer receiver.

2. The archery bow handle of claim 1 wherein the stabilizer receiver comprises a plurality of apertures, the plurality of apertures configured to permit variable positioning of an archery bow stabilizer received by the stabilizer receiver.

3. The archery bow handle of claim 1 wherein the stabilizer receiver comprises:

a first end;

a second end displaced from the first end; and a slot positioned between the first and second ends, the slot configured to permit variable positioning of an archery bow stabilizer received by the stabilizer receiver.

4. An archery bow comprising the handle of claim 1.

5. An archery bow handle defining a major longitudinal handle axis comprising:

a handgrip portion;

a stabilizer receiver laterally displaced from the handgrip portion and configured to receive a threaded extension of an archery bow stabilizer and to support an entirety of said archery bow stabilizer by the threaded extension; and a cavity between the stabilizer receiver and the handgrip portion.

6. The archery bow handle of claim 5 wherein the stabilizer receiver and the handgrip portion are comprised by one piece of material.

7. The archery bow handle of claim 5 wherein the stabilizer receiver comprises a plurality of apertures, the plurality of apertures configured to permit variable positioning of an archery bow stabilizer engaged by the stabilizer receiver.

8. The archery bow handle of claim 5 wherein the stabilizer receiver comprises:

a first end;

a second end longitudinally displaced from the first end; and a longitudinally extending slot between the first and second ends, the longitudinally extending slot configured to permit variable longitudinal positioning of the archery bow stabilizer engaged by the stabilizer receiver.

9. The archery bow handle of claim 5 wherein the handgrip portion defines a forward direction in which an arrow would be launched, and wherein the stabilizer receiver is laterally displaced forwardly of the handgrip portion.

10. An archery bow comprising the handle of claim 5.

11. An archery bow handle defining a major longitudinal handle axis comprising:

a handgrip portion; and a stabilizer receiver laterally displaced from the handgrip portion and configured to permit variable longitudinal positioning of an archery bow stabilizer engaged by the stabilizer receiver, the stabilizer receiver comprising a plurality of apertures longitudinally displaced from one another, the plurality of apertures being longitudinally aligned directly over one another, the plurality of apertures configured to permit variable longitudinal positioning of an archery bow stabilizer engaged by the stabilizer receiver.

12. The archery bow handle of claim 11 wherein the stabilizer receiver is configured to threadedly engage an archery bow stabilizer.

13. The archery bow handle of claim 11 wherein the handgrip portion defines a forward direction in which an arrow would be launched, and wherein the stabilizer receiver is laterally displaced forwardly of the handgrip portion.

14. An archery bow comprising the handle of claim 11.

15. An archery bow handle defining a major longitudinal handle axis comprising:

a handgrip portion; and a stabilizer receiver laterally displaced from the handgrip portion and configured to permit variable longitudinal positioning of an archery bow stabilizer engaged by the stabilizer receiver, the stabilizer receiver comprising:

a first end;

a second end longitudinally displaced from the first end; and a longitudinally extending slot between the first and second ends, the longitudinally extending slot being configured to permit variable longitudinal positioning of an archery bow stabilizer engaged by the stabilizer receiver, the longitudinally extending slot being configured to receive a threaded extension of an archery bow stabilizer and to support an entirety of said archery bow stabilizer by the threaded extension.

16. An archery bow handle defining a major longitudinal handle axis comprising:

a handgrip portion; and a stabilizer receiver laterally displaced from the handgrip portion and configured to permit variable longitudinal positioning of an archery bow stabilizer engaged by the stabilizer receiver, the stabilizer receiver comprising:

a first end;

a second end displaced from the first end; and a slot between the first and second ends, the slot configured to permit positioning of an archery bow stabilizer engaged by the stabilizer receiver at multiple points between the two ends, the slot being configured to receive a threaded extension of an archery bow stabilizer and to support an entirety of said archery bow stabilizer by the threaded extension.

17. A stabilizer receiver configured for use with an archery bow and configured for mounting an archery bow stabilizer in variable positions relative to the archery bow comprising:

a body configured to be laterally displaced from a riser portion of an archery bow, the body and the riser portion being comprised by one piece of material; and a plurality of apertures within the body and extending within the body, at least two of the apertures being longitudinally displaced from one another.

18. A stabilizer receiver configured for use with an archery bow and configured for mounting an archery bow stabilizer in variable positions relative to the archery bow comprising:

a body; and a slot extending within the body and through the body, the slot configured to permit variable positioning of an archery bow stabilizer engaged by the stabilizer receiver, the slot being configured to receive a threaded extension of an archery bow stabilizer and to support an entirety of said archery bow stabilizer by the threaded extension.

19. The stabilizer receiver of claim 18, further comprising;

an elongated shoulder provided substantially coextensively within the slot, the shoulder being defined by opposed inwardly facing abutments, the abutments being separated by a space therebetween having a width sufficient to slidably receive a threaded bolt therethrough, the abutments having exposed surfaces defining bearing surfaces against which a predetermined size threaded nut received by the threaded bolt and slot can tightly bear for securing a stabilizer to the handle, the slot defining locking wrench jaws that are adapted to slidably receive the predetermined size threaded nut therebetween but prevent such nut from rotating with the slot.

20. The stabilizer of claim 18 wherein the body comprises a major longitudinal axis and wherein the slot extends along the major longitudinal axis.

21. A stabilizer receiver configured for use with an archery bow and configured for mounting an archery bow stabilizer in variable positions relative to the archery bow comprising:

a body configured for lateral displacement relative to an archery bow riser portion; and an archery bow stabilizer receiving system associated with the body, the receiving system permitting longitudinal displacement of an archery bow stabilizer across a range of variable positions, the receiving system being configured to receive a threaded extension of an archery bow stabilizer and to support an entirety of said archery bow stabilizer by the threaded extension.

22. The stabilizer receiver of claim 21 wherein the receiving system permits only discontinuous displacement across the range of variable positions.

23. The stabilizer receiver of claim 21 wherein the receiving system permits only discontinuous displacement across the range of variable positions and comprises a plurality of apertures, the apertures being configured for receiving the archery bow stabilizer individually.

24. The stabilizer receiver of claim 21 wherein the receiving system permits continuous displacement across the range of variable positions.

25. The stabilizer receiver of claim 21 wherein the receiving system permits continuous displacement across the range of variable positions and comprises a slot configured for slidable displacement of the archery bow stabilizer.

26. An archery bow handle defining a major longitudinal handle axis comprising:

a first end;

a second end longitudinally displaced from the first end;

a handgrip portion positioned longitudinally between the first and second ends and configured to be grasped by an archer's hand;

a stabilizer receiver forwardly displaced from the handgrip portion and configured to receive an archery bow stabilizer, the stabilizer receiver and the handgrip portion overlapping at a common longitudinal displacement from the first end, the stabilizer receiver comprising a plurality of apertures, the plurality of apertures being configured to permit variable positioning of an archery bow stabilizer received by the stabilizer receiver; and a cavity between the stabilizer receiver and the handgrip portion, the cavity being sized to enable one or more of the fingers of the archer's hand to slide between the handgrip portion and the stabilizer receiver.

27. An archery bow handle defining a major longitudinal handle axis comprising:

a handgrip portion;

a stabilizer receiver laterally displaced from the handgrip portion and configured to engage an archery bow stabilizer, the stabilizer receiver and the handgrip portion being comprised by one piece of material; and a cavity between the stabilizer receiver and the handgrip portion.

28. An archery bow handle defining a major longitudinal handle axis comprising:

a handgrip portion;

a stabilizer receiver laterally displaced from the handgrip portion and configured to engage an archery bow stabilizer, the stabilizer receiver comprising a plurality of apertures, the plurality of apertures being configured to permit variable positioning of an archery bow stabilizer engaged by the stabilizer receiver; and a cavity between the stabilizer receiver and the handgrip portion.

29. An archery bow handle defining a major longitudinal handle axis comprising:

a handgrip portion; and a stabilizer receiver laterally displaced from the handgrip portion and configured to permit variable longitudinal positioning of an archery bow stabilizer engaged by the stabilizer receiver, the stabilizer receiver comprising:

a first end;

a second end displaced from the first end;

a slot between the first and second ends, the slot configured to permit variable positioning of an archery bow stabilizer engaged by the stabilizer receiver; and an elongated shoulder provided substantially coextensively within the slot, the shoulder being defined by opposed inwardly facing abutments, the abutments being separated by a space therebetween having a width sufficient to slidably receive a threaded bolt therethrough, the abutments having exposed surfaces defining bearing surfaces against which a predetermined size threaded nut received by the threaded bolt and slot can tightly bear for securing a stabilizer to the handle, the slot defining locking wrench jaws that are adapted to slidably receive the predetermined size threaded nut therebetween but prevent such nut from rotating with the slot.

30. A stabilizer receiver configured for use with an archery bow and configured for mounting an archery bow stabilizer in variable positions relative to the archery bow comprising:

a body configured to be laterally displaced from a riser portion of an archery bow, the body being configured to be integral with said riser portion; and a plurality of apertures within the body and extending within the body.

31. A stabilizer receiver configured for use with an archery bow and configured for mounting an archery bow stabilizer in variable positions relative to the archery bow comprising:

a body configured to be laterally displaced from a riser portion of an archery bow; and a plurality of apertures within the body and extending within the body, the body comprising a major longitudinal axis and the apertures being displaced from one another along the major longitudinal axis.

32. A stabilizer receiver configured for use with an archery bow and configured for mounting an archery bow stabilizer in variable positions relative to the archery bow comprising:

a body;

a slot extending within the body and through the body, the slot configured to permit variable positioning of an archery bow stabilizer engaged by the stabilizer receiver; and an elongated shoulder provided substantially coextensively within the slot, the shoulder being defined by opposed inwardly facing abutments, the abutments being separated by a space therebetween having a width sufficient to slidably receive a threaded bolt therethrough, the abutments having exposed surfaces defining bearing surfaces against which a predetermined size threaded nut received by the threaded bolt and slot can tightly bear for securing a stabilizer to the handle, the slot defining locking wrench jaws that are adapted to slidably receive the predetermined size threaded nut therebetween but prevent such nut from rotating with the slot.

* * * * *